US005980432A

United States Patent [19]

Ahman

[11] Patent Number: 5,980,432

[45] Date of Patent: Nov. 9, 1999

[54] HOPPING VEHICLE

[76] Inventor: Daniel Ahman, 208 Lincoln Blvd., Venice, Calif. 90291

[21] Appl. No.: 09/061,214

[22] Filed: Apr. 16, 1998

[51] Int. Cl.[6] ..... A63B 25/08

[52] U.S. Cl. ..... 482/77; 482/51; 280/12.11; 280/221

[58] Field of Search ..... 482/77, 75, 80, 482/128, 121, 122, 123, 126, 133, 138, 74, 51, 71, 72; 280/1.175, 827, 1.181, 12.11, 12.12, 221, 758; 472/103, 104, 95, 110

[56] References Cited

U.S. PATENT DOCUMENTS

| | | | |
|---|---|---|---|
| 980,634 | 1/1911 | Hazelton | 482/51 |
| 1,498,677 | 6/1924 | Bemis et al. | 280/221 |
| 1,604,245 | 10/1926 | Taylor et al. | 280/1.175 |
| 3,598,404 | 8/1971 | Bowman | 482/77 |
| 4,133,551 | 1/1979 | Biskup | 280/221 |
| 4,452,448 | 6/1984 | Ausherman | 482/30 |
| 4,606,266 | 8/1986 | Hyman, Sr. | 100/233 |
| 4,776,586 | 10/1988 | Hardee | 482/129 |
| 4,912,859 | 4/1990 | Ritts | 482/77 |
| 5,163,696 | 11/1992 | Pesco, Sr. | 280/221 |
| 5,284,460 | 2/1994 | Miller et al. | 482/51 |
| 5,352,173 | 10/1994 | McLaughlin | 482/121 |
| 5,368,536 | 11/1994 | Stodgell | 482/79 |
| 5,634,870 | 6/1997 | Wilkinson | 482/30 |
| 5,713,819 | 2/1998 | Hsieh | 482/77 |

*Primary Examiner*—Richard J. Apley
*Assistant Examiner*—Justine R. Yu

[57] ABSTRACT

A new hopping vehicle for travelling a distance by spring aided hopping. The inventive device includes a ground engaging base, a lever member, and an elongate handle all hingedly coupled together by a hinge member at their proximal ends. A foot platform for standing on is coupled to the distal end of the lever member. A spring is interposed between the base and the lever member to bias the base and lever member away from each other.

7 Claims, 2 Drawing Sheets

HOPPING VEHICLE

BACKGROUND OF THE INVENTION

1. Field of the Invention

The present invention relates to hopping vehicles and more particularly pertains to a new hopping vehicle for travelling a distance by spring aided hopping.

2. Description of the Prior Art

The use of hopping vehicles is known in the prior art. More specifically, hopping vehicles heretofore devised and utilized are known to consist basically of familiar, expected and obvious structural configurations, notwithstanding the myriad of designs encompassed by the crowded prior art which have been developed for the fulfillment of countless objectives and requirements.

Known prior art hopping vehicles include U.S. Pat. No. 4,243,218; U.S. Pat. No. 5,087,037; U.S. Pat. No. 4,390,178; U.S. Pat. No. 4,696,467; U.S. Pat. No. 5,009,415; and U.S. Pat. No. Des. 263,485.

While these devices fulfill their respective, particular objectives and requirements, the aforementioned patents do not disclose a new hopping vehicle. The inventive device includes a ground engaging base, a lever member, and an elongate handle all hingedly coupled together by a hinge member at their proximal ends. A foot platform for standing on is coupled to the distal end of the lever member. A spring is interposed between the base and the lever member to bias the base and lever member away from each other.

In these respects, the hopping vehicle according to the present invention substantially departs from the conventional concepts and designs of the prior art, and in so doing provides an apparatus primarily developed for the purpose of travelling a distance by spring aided hopping.

SUMMARY OF THE INVENTION

In view of the foregoing disadvantages inherent in the known types of hopping vehicles now present in the prior art, the present invention provides a new hopping vehicle construction wherein the same can be utilized for travelling a distance by spring aided hopping.

The general purpose of the present invention, which will be described subsequently in greater detail, is to provide a new hopping vehicle apparatus and method which has many of the advantages of the hopping vehicles mentioned heretofore and many novel features that result in a new hopping vehicle which is not anticipated, rendered obvious, suggested, or even implied by any of the prior art hopping vehicles, either alone or in any combination thereof.

To attain this, the present invention generally comprises a ground engaging base, a lever member, and an elongate handle all hingedly coupled together by a hinge member at their proximal ends. A foot platform for standing on is coupled to the distal end of the lever member. A spring is interposed between the base and the lever member to bias the base and lever member away from each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hopping vehicle apparatus and method which has many of the advantages of the hopping vehicles mentioned heretofore and many novel features that result in a new hopping vehicle which is not anticipated, rendered obvious, suggested, or even implied by any of the prior art hopping vehicles, either alone or in any combination thereof.

It is another object of the present invention to provide a new hopping vehicle which may be easily and efficiently manufactured and marketed.

It is a further object of the present invention to provide a new hopping vehicle which is of a durable and reliable construction.

An even further object of the present invention is to provide a new hopping vehicle which is susceptible of a low cost of manufacture with regard to both materials and labor, and which accordingly is then susceptible of low prices of sale to the consuming public, thereby making such hopping vehicle economically available to the buying public.

Still yet another object of the present invention is to provide a new hopping vehicle which provides in the apparatuses and methods of the prior art some of the advantages thereof, while simultaneously overcoming some of the disadvantages normally associated therewith.

Still another object of the present invention is to provide a new hopping vehicle for travelling a distance by spring aided hopping.

Yet another object of the present invention is to provide a new hopping vehicle which includes a ground engaging base, a lever member, and an elongate handle all hingedly coupled together by a hinge member at their proximal ends. A foot platform for standing on is coupled to the distal end of the lever member. A spring is interposed between the base and the lever member to bias the base and lever member away from each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
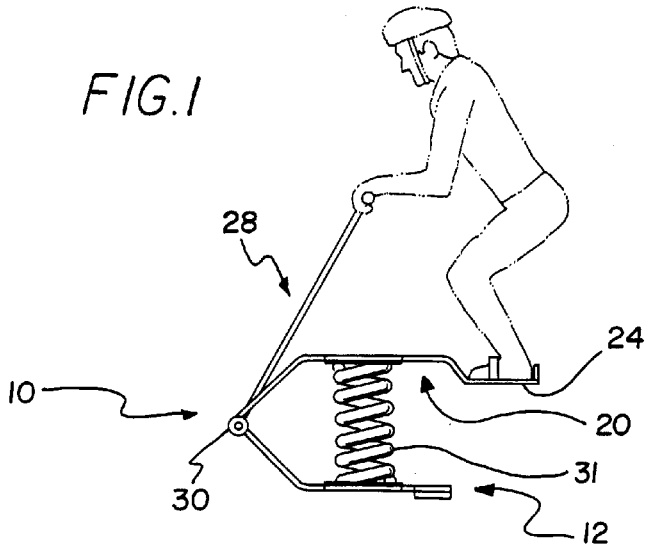
FIG. 1 is a schematic side view of a new hopping vehicle in use according to the present invention.
Figure 2:
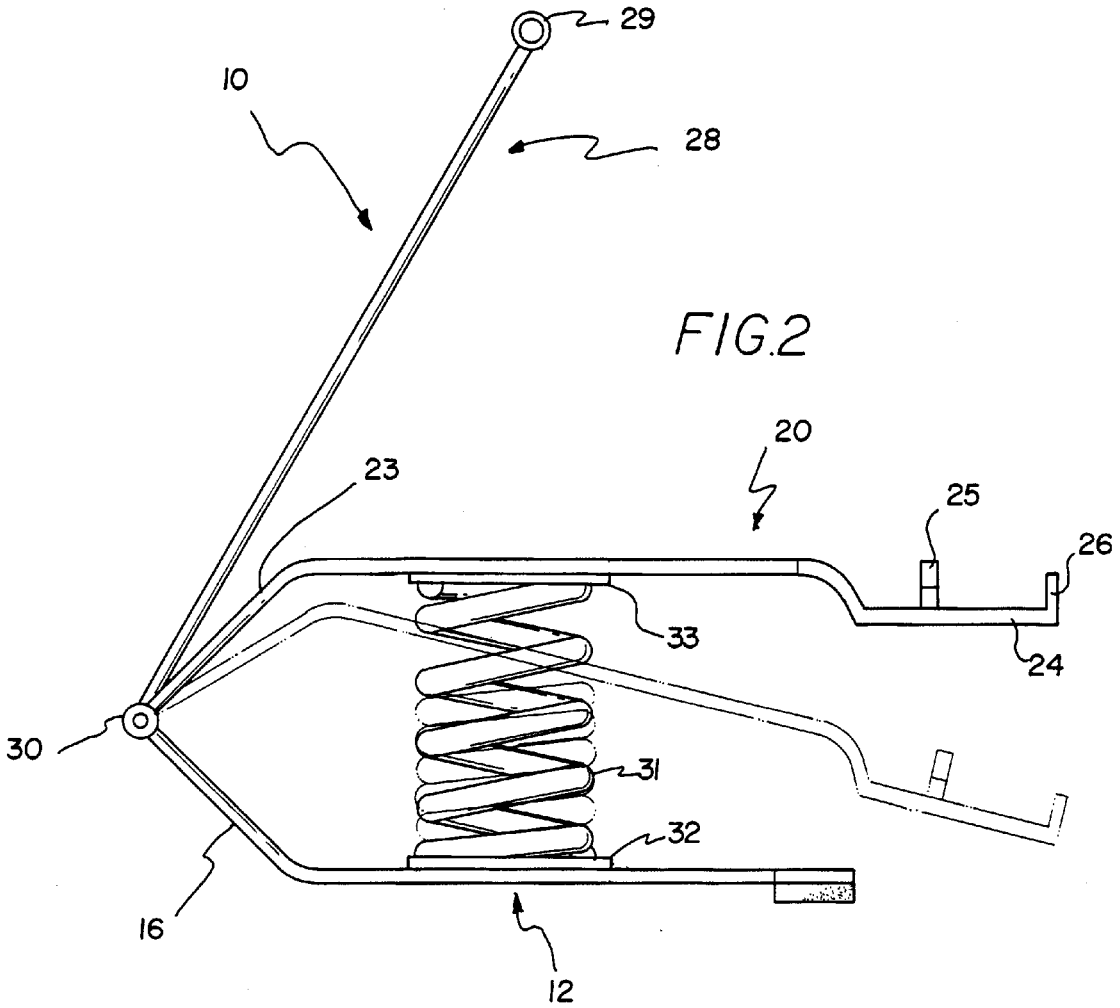
FIG. 2 is a schematic side view of the present invention.
Figure 3:
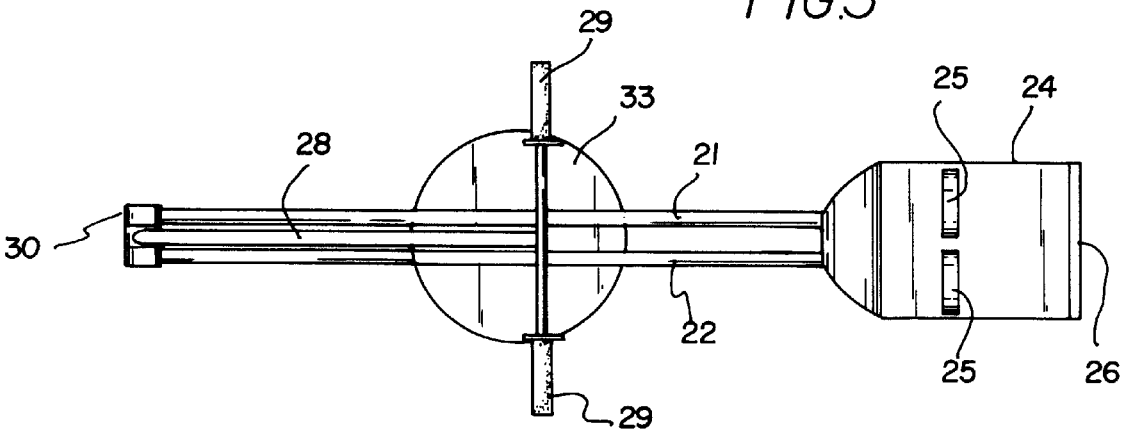
FIG. 3 is a schematic top side view of the present invention.
Figure 4:
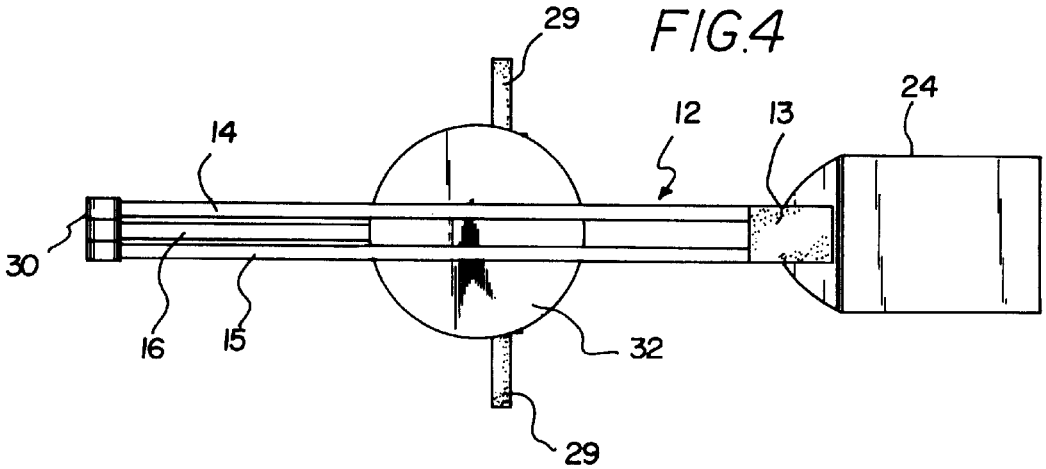
FIG. 4 is a schematic bottom side view of the present invention.

With reference now to the drawings, and in particular to FIGS. 1 through 4 thereof, a new hopping vehicle embodying the principles and concepts of the present invention and generally designated by the reference numeral 10 will be described.

As best illustrated in FIGS. 1 through 4, the hopping vehicle 10 generally comprises a ground engaging base 12, a lever member 20, and an elongate handle 28 all hingedly coupled together by a hinge member 30 at their proximal ends. A foot platform 24 for standing on is coupled to the distal end of the lever member 20. A spring 31 is interposed between the base 12 and the lever member 20 to bias the base 12 and lever member 20 away from each other.

In closer detail, the ground engaging base 12 has opposite proximal and distal ends, a top and a bottom. The base 12 preferably comprises a pair of spaced apart elongate base rods 14,15 extending between the proximal and distal ends of the base 12. Preferably, each of the base rods 14,15 has an upwardly extending portion 16 located adjacent the proximal end of the base 12 and a reminder portion located adjacent the distal end of the base for engaging a ground surface. The upwardly extending portions 16 of the base rods 14,15 are upwardly extended at an acute angle with respect to the remainder of the base 12 rod. A generally rectangular pad 13 is coupled to the bottom of the base 12. The pad 13 is positioned adjacent the distal end of the base 12. Preferably, the pad 13 comprises a resiliently compressible and frictionally enhanced material such as rubber.

The lever member 20 has opposite proximal and distal ends, a top, and a bottom. Like the base, the lever member 20 preferably comprises a pair of spaced apart lever rods 21,22 extending between the proximal and distal ends of the lever member 20. Preferably, each of the lever rods 21,22 of the lever member 20 has a downwardly extending portion 23 located adjacent the proximal end of the lever member 20 and a remainder portion located adjacent the distal end of the lever member. The downwardly extending portions 23 of the lever rods 21,22 of the lever member 20 are downwardly extended at an acute angle with respect the remainder of the lever member 20. A generally rectangular foot platform 24 is coupled to the distal end of the lever member 20. The foot platform 24 is designed for resting the feet of a user standing thereon. The foot platform 24 has a pair of foot straps 25 each adapted for looping around a foot. Ideally, the foot platform 24 also has a heel flange 26 upwardly extending therefrom away from the distal end of the lever member 20. The heel flange 26 is designed for abutting the heels of the feet of a user standing on the foot platform 24. The heel flange is located adjacent a free outer edge of the foot platform opposite the distal ends of the lever member. The foot platform has an arcuate forwards portion adjacent the distal end of the lever member. The arcuate forwards portion of the foot platform has a forwardly and downwardly facing concavity. The arcuate forwards portion positions the foot platform in a plane substantially parallel and below a plane in which the lever member lies. The arcuate forwards portion provides a front stop for abutting the toes of a user standing on the foot platform to help prevent forwards sliding of the user's feet on the foot platform.

The elongate handle 28 has opposite proximal and distal ends. The distal end of the handle 28 has a pair of oppositely extended handgrips 29 which are designed for gripping by a user standing on the foot platform 24 as illustrated in FIG. 1.

The hinge member 30 hingedly couples the proximal ends of the base 12, the lever member 20 and the handle 28 together. The hinge member 30 permits pivoting of the base 12, the lever member 20 and the handle 28 with respect to one another. A spring 31 is interposed between the base 12 and the lever member 20 to bias the base 12 and lever member 20 away from each other. Preferably, a generally disk-shaped lower spring platform 32 is coupled to the top of the base 12 and positioned between the proximal and distal ends of the base 12. Similarly, a generally disk-shaped upper spring platform 31 is coupled to the bottom of the lever member 20 and is positioned between the proximal and distal ends of the lever member 20. The upper end of the spring 31 is coupled to the upper spring platform 31 while the lower end of the spring 31 is coupled to the lower spring platform 32 to hold the spring to the lever member and the base.

In use, a user stands on the foot platform with the base resting on a ground surface. The user then hops on the foot platform 24. This pivots the base 12 and lever member 20 together to compress the spring 31. The spring 31 forces the lever member 20 and base 12 apart to assist the height and distance of the hop.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hopping vehicle, comprising:

a ground engaging base having opposite proximal and distal ends, a top and a bottom, a lever member having opposite proximal and distal ends, a top, and a bottom;

said lever member further comprising a pair of spacing apart lever rods extending between said proximal and distal ends of said lever member;

a foot platform being coupled to said distal end of said lever member, said foot platform being for resting the feet of a user standing thereon;

an elongate handle having opposite proximal and distal ends, said distal end of said handle having a pair of oppositely extended handgrips, said handgrips being for gripping by a user standing on said foot platform;

a hinge member pivotally coupling said proximal ends of said base, said lever member and said handle together, said hinge member permitting pivoting of said base, said lever member and said with respect to one another;

a spring being interposed between said base and said lever member, said spring biasing said base and lever member away from each other;

wherein each of said lever rods of said lever member has a downwardly extending portion located adjacent said proximal end of said level member;

wherein said base comprises a pair of spaced apart elongate base rods extending between said proximal and distal ends of said base, and wherein each of said base rods has an upwardly extending portion located adjacent said proximal end of said base for aiding forwards movement of a user hopping on said hopping vehicle.

2. The hopping vehicle of claim 1, further comprising a pad being coupled to said bottom of said ground engaging base, said pad being positioned adjacent said distal end of said ground engaging base for aiding forwards movement of a user hopping on said hopping vehicle.

3. The hopping vehicle of claim 1, wherein said foot platform has a pair of foot straps each adapted for looping around a foot.

4. The hopping vehicle of claim 3, wherein said foot platform has a heel flange upwardly extending therefrom adjacent a free outer edge of said foot platform opposite said distal ends of said lever member, wherein said foot platform has an arcuate forwards portion adjacent said distal end of said lever member, said arcuate forwards portion of said foot platform having a forwardly and downwardly facing concavity, said arcuate forwards portion positioning said foot platform in a plane substantially parallel and below a plane in which said lever member lies, said arcuate forwards portion providing a front stop for abutting the toes of a user standing on said foot platform to help prevent forwards sliding of the user's feet on the foot platform.

5. The hopping vehicle of claim 1, further comprising a lower spring platform being coupled to said top of said ground engaging base, said lower spring platform being positioned between said proximal and distal ends of said ground engaging base, and further comprising an upper spring platform being coupled to said bottom of said lever member, said upper spring platform being positioned between said proximal and distal ends of said lever member.

6. The hopping vehicle of claim 5, wherein said spring has upper and lower ends, said upper end of said spring being coupled to said upper spring platform, said lower end of said spring being coupled to said lower spring platform.

7. A hopping vehicle, comprising:

a ground engaging base having opposite proximal and distal ends, a top and a bottom;

said base comprising a pair of spaced apart elongate base rods extending between said proximal and distal ends of said base;

a pad being generally rectangular and being coupled to said bottom of said base, said pad being positioned adjacent said dismal end of said base, wherein said pad comprises a resiliently compressible material;

each of said base rods having an upwardly extending portion located adjacent said proximal end of said base and a remainder portion located adjacent said distal end of said base for engaging a ground surface, said upwardly extending, portions of said base rods being upwardly extended at an acute angle with respect to the remainder portion of said base rod;

a lever member having opposite proximal and distal ends, a top, and a bottom;

said lever member comprising a pair of spaced apart lever rods extending between said proximal and distal ends of said lever member:

a foot platform being coupled to said distal end of said lever member, said foot platform being for resting the feet of a user standing thereon, said foot platform having a pair of foot straps each adapted for looping around a foot, said foot platform having a heel flange upwardly extending therefrom adjacent a free outer edge of said foot platform opposite said distal ends of said lever member, wherein said foot platform has an arcuate forwards portion adjacent said distal end of said lever member, said arcuate forwards portion of said foot platform having a forwardly and downwardly facing concavity, said arcuate forwards portion positioning said foot platform in a plane substantially parallel and below a plane in which said lever member lies, said arcuate forwards portion providing a front stop for abutting the toes of a user standing on said foot platform to help prevent forwards sliding of the user's feet on the foot platform;

each of said lever rods of said lever member having a downwardly extending portion located adjacent said proximal end of said lever member and a remainder portion located adjacent said distal end of said lever member, said downwardly extending portion of said rods of said level member being downwardly extended at an acute angle with respect to the remainder portion of said lever member;

an elongate handle having opposite proximal and distal ends, said distal end of said handle having a pair of oppositely extended handgrips, said handgrips being for gripping by a user standing on said foot platform;

a hinge member pivotally coupling said proximal ends of said base, said lever member and said handle together, said hinge member permitting pivoting of said base, said lever member and said handle with respect to one another;

a spring being interposed between said base and said lever member, said spring biasing said base and level member away from each other;

a lower spring platform being generally disk-shaped and being coupled to said top of said base, said lower spring platform being positioned between said proximal and distal ends of said base;

an upper spring platform being generally disk-shaped and being coupled to said bottom of said lever member, said upper spring platform being positioned between said proximal and distal ends of said lever member; and said spring having upper and lower ends, said upper end of said spring being coupled to said upper spring platform, said lower end of said spring being coupled to said lower spring platform; and said remainder portion of said lever rods and said remainder portion of said base rods lying in substantially parallel planes when said spring is in an uncompressed configuration.

* * * * *